US006834396B2

(12) United States Patent
Franco-Sion

(10) Patent No.: US 6,834,396 B2
(45) **Date of Patent: *Dec. 28, 2004**

(54) WEIGHT VEST

(76) Inventor: Ana F. Franco-Sion, 9913 Robin Oaks Dr., Las Vegas, NV (US) 89117

( * ) Notice: Subject to any disclaimer, the term of this patent is extended or adjusted under 35 U.S.C. 154(b) by 0 days.

This patent is subject to a terminal disclaimer.

(21) Appl. No.: 10/430,371

(22) Filed: May 5, 2003

(65) Prior Publication Data

US 2004/0000003 A1 Jan. 1, 2004

Related U.S. Application Data

(63) Continuation of application No. 09/919,271, filed on Jul. 30, 2001, now Pat. No. 6,557,176.

(51) Int. Cl.[7] ..... A41D 1/04
(52) U.S. Cl. ..... 2/102
(58) Field of Search ..... 2/102, 69, 115, 2/105, 83, 94, 2.5, 81, 253; 482/74, 105, 139

(56) References Cited

U.S. PATENT DOCUMENTS 4,344,620 A 8/1982 Debski
4,394,012 A 7/1983 Egbert et al.
4,637,075 A 1/1987 Igrisano et al.
5,002,270 A 3/1991 Shine
5,617,582 A 4/1997 Burwell
5,810,699 A 9/1998 Nadeau
6,189,149 B1 2/2001 Allen
6,314,580 B1 * 11/2001 Greenberg et al. ..... 2/108
6,557,176 B2 * 5/2003 Franco-Sion ..... 2/102

* cited by examiner

*Primary Examiner*—Tejash Patel
(74) *Attorney, Agent, or Firm*—Weide & Miller, Ltd.

(57) ABSTRACT

The present invention is a weight vest including a shell constructed of a plurality of panels defining a front and a back. The front of the vest has a first side and a second side which are selectively connectable, such as with a zipper, a flap and/or one or more straps. The shell including first and second arm openings located opposite one another and a neck opening. The shell has an exterior and an interior, and a lower portion generally opposite the neck opening. A lining is connected to the shell and located at the interior thereof. At least one upper weight pocket is located at the interior of the shell adjacent one of the arm openings. At least one lower weight pocket is located at the interior of the shell near the lower portion of the shell. Each pocket includes an opening into which a weight may be placed, the opening selectively closeable for retaining said weight therein. In one embodiment, a flap is associated with each pocket, the flap moveable between an open position and a closed position over the opening(s) of the pocket. In one embodiment, each weight pocket defines a plurality of individual weight accepting compartments.

10 Claims, 3 Drawing Sheets

WEIGHT VEST

RELATED APPLICATION DATA

This application is a continuation of U.S. patent application Ser. No. 09/919,271, filed Jul. 30, 2001 now U.S. Pat. No. 6,557,176.

FIELD OF THE INVENTION

The present invention relates to exercise clothing, and more particularly to a vest with which one or more weights may be associated.

BACKGROUND OF THE INVENTION

A variety of fitness and training techniques are known. A common training technique is the moving of a mass, such as a metal weight. In one form of training, one or more weights are either directly moved or mounted to a support which is moved. This type of training is known as "free weight" training. In another form of weight training, weights are associated with a mechanical apparatus. For example, a weight may be located at one end of a cable. The cable may pass over one or more pulleys to a handle or grip. The user grips the handle and moves the cable, and thus the weight attached to the cable.

A problem with both of these forms of weight training is that the apparatus or free weights are not suited to being transported. The user travels to the location of the weights or apparatus, exercises, and then leaves the location of the weights or apparatus. There are numerous drawbacks to this arrangement. Among these drawbacks are that the user can not train unless the user is at the location of the weights or apparatus. Another problem is that the user can not generally engage in other activities while training.

As one attempt to overcome these problems, ankle and wrist weights have been developed. These devices generally comprise a flexible annular member filled with metal shot. The weighted device may be placed around the ankle or wrist. So worn, the user may walk, run or engage in other activities which are generally not permitted when using free weights or weight apparatus. On the other hand, these devices still have significant drawbacks. One drawback is that all of the weight is concentrated at the angle or wrist, centralizing the load. This is uncomfortable and does not always yield the best training results. In addition, because the devices are attached to a generally circular area of the body, its is difficult to constrain the device while the user is moving. For example, while running these devices may move up and down with respect to the body, counteracting the desired training effect and interfering with the user's balance.

Other attempts at solving these problems have been unsuccessful as well. General problems associated with wearable weight systems are numerous. A significant problem is that such devices are not fully constrained and may move relative to the body. In general, training with these devices is most effective when the body is in motion, thus requiring movement of the associated weight device. However, because the device is not fully constrained, the heightened movement of the user during exercise generally results in heightened relative movement of the device. Again, this counteracts the desired training effect and can cause instability and discomfort to a user. In addition, it is desirable to be able to readily be able to change the amount of weight which is associated with the device and the location of the device. Current devices do not satisfactorily address these needs.

SUMMARY OF THE INVENTION

The present invention comprises a wearable vest adapted to support one or more weights.

In one embodiment, the weight vest includes a shell constructed of a plurality of panels. The panels define a front and a back of the vest. The front of the vest has a first side and a second side. The first and second sides are selectively connectable, such as with a zipper.

The shell including first and second arm openings located opposite one another. The shell also defines a neck opening. The shell has an exterior and an interior, and a lower portion generally opposite the neck opening.

In one embodiment, the first and second sides of the shell are connectable by at least one member in addition to the zipper. First, a flap extends from either the first or second sides towards the other. The flap is selectively connectable to the other side, such as with hook and loop fastening material. Second, in one embodiment, a pair of adjustable straps are provided. Each strap has a first portion associated with the first side and a second portion associated with the second side of the shell, the first and second portions of the straps selectively connectable.

A lining is connected to the shell and located at the interior thereof. At least one upper weight pocket is located at the interior of the shell. The at least one upper weight pocket is located adjacent one of the arm openings. At least one lower weight pocket is located at the interior of the shell. The at least one lower weight pocket is located near the lower portion of the shell. Each pocket includes an opening into which a weight may be placed, the opening selectively closeable for retaining the weight therein. In one embodiment, a flap is associated with each pocket, the flap moveable between an open position and a closed position over the opening(s) of the pocket.

In one embodiment, the upper and lower weight pockets are formed from or in the lining of the shell. The pockets may comprise two layers of lining material.

In a preferred embodiment, each weight pocket defines a plurality of individual weight accepting compartments. Each compartment includes an opening through which a weight may be inserted.

In one embodiment, a pair of weight pockets are located on either side of the first arm opening. A second pair of weight pockets are located on either side of the second arm opening. A plurality of weight pockets are located along the lower edge of the interior of the shell.

In one embodiment, forty (40) compartments are provided. Each compartment is generally elongate in relation to its width, and designed to accept a generally rectangular weight.

The shell is preferably constructed at least in part of an semi-elastic material such as neoprene. The lining is preferably constructed of a breathable mesh material.

Further objects, features, and advantages of the present invention over the prior art will become apparent from the detailed description of the drawings which follows, when considered with the attached figures.

DETAILED DESCRIPTION OF THE INVENTION

The present invention is a weight vest. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the present invention comprises a wearable structure capable of supporting one or more weights. In a preferred configuration, the structure comprises a vest capable of supporting one or more weights or weight elements.

Figure 1:
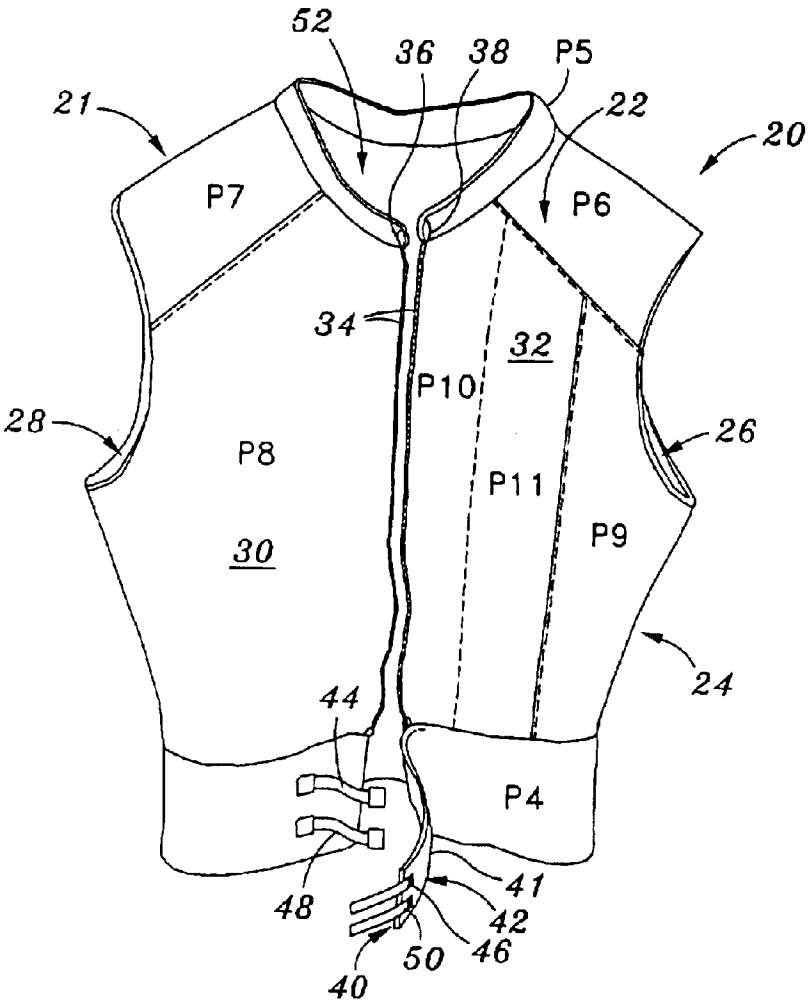
FIG. 1 is a front view of an embodiment of a weight vest in accordance with the present invention.

One embodiment of a weight vest 20 in accordance with the present invention will be described first with reference to FIG. 1. Preferably, the weight vest 20 is of the type which is adapted to be worn about the torso of a human.

Figure 3:
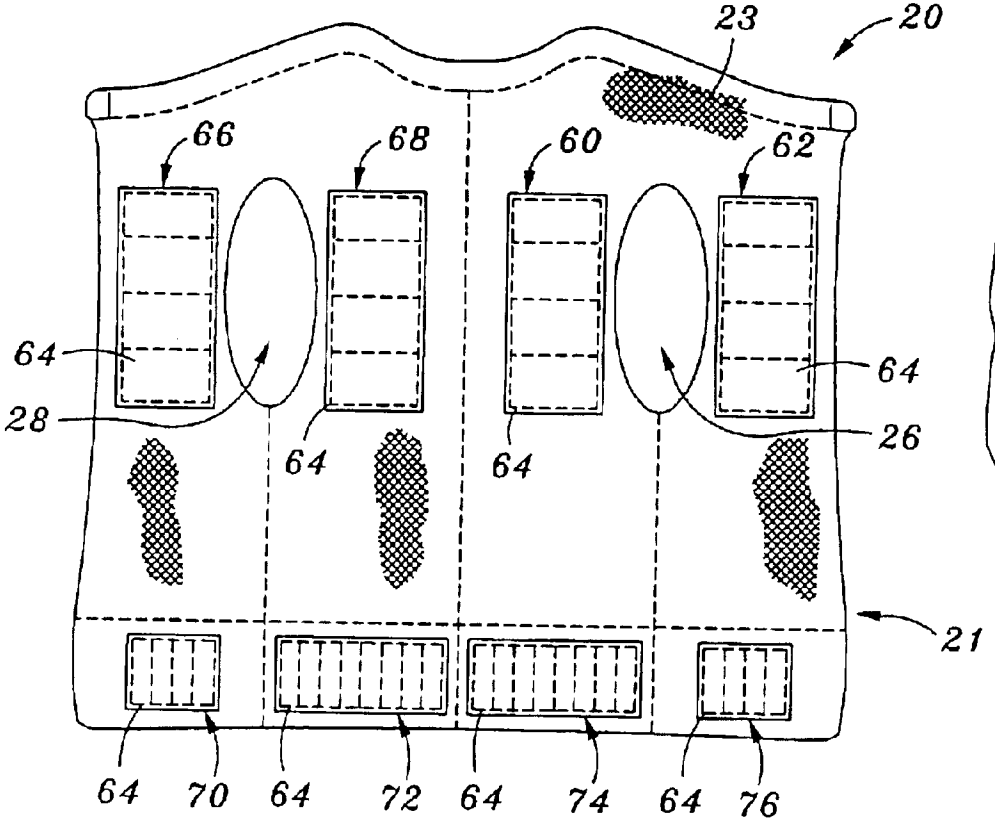
FIG. 3 is a front view of the weight vest illustrated in FIG. 1 showing an interior thereof.

In one embodiment, the weight vest 20 generally comprises a shell or body 21 and a lining 23 (see FIG. 3). The shell of body 21 has a front 22 and a back or rear 24. When worn, the front 22 is located at the front (i.e. chest) of a wearer. The back 24 is located at the back of the wearer.

A first opening 26 is provided through which a first arm of a wearer may extend. A second opening 28 is provided through which a second arm of a wearer may extend.

In one embodiment, the front 22 is divided into a first side 30 and a second side 32. When connected, the first and second sides 30,32 generally define a contiguous front 22. When disconnected, the first and second sides 30,32 define an opening there between.

At least one means is preferably provided for selectively connecting and disconnecting the first and second sides 30,32. In one embodiment, this means includes a zipper 34. In a preferred embodiment, the first side 30 has a generally vertically extending edge 36. The second side 32 has a similar vertically extending edge 38. The zipper 36 is associated with these edges 36,38. As described in more detail below, the zipper 36 permits a wearer to selectively couple at least portions of the opposing edges 36,38 of the first and second sides 30,32.

In one embodiment, at least one additional means is provided for coupling the first and second sides 30,32. In one embodiment, this means includes a flap 41. In one embodiment, the flap 41 comprises an extension of a lower panel P4 (described in more detail) of the shell 21 of the vest 20. This flap 41 extends from the second side 32 a sufficient distance to overlay the first side 30.

Means are provided for securing the flap 41 to the opposing side of the vest 20, in this case the first side 30. In one embodiment, the means comprises hook and loop fastening material (such as that sold under the trademark VELCRO). Mating portions of the material are associated with the inside surface of the flap 41 and the outside surface of the lower first side 30. As described below, in this arrangement a user may extend the flap across to the first side 30 such that the flap 41 connects the first and second sides 30,32 of the vest 20.

In a preferred embodiment, the vest 20 also includes first and second straps 40,42 for use in selectively connecting the first and second sides 30,32 thereof. In a preferred embodiment, the first strap 40 includes a first portion 44 connected to the first side 30 near the edge 36 thereof, and a second portion 46 connected to flap 41. The first and second portions 44,46 of the first strap 40 including mating locking elements, such as buckles, snaps or the like for selectively connecting the two portions 44,46 to one another. In a preferred embodiment, at least one of the portions 44,46 is provided with a length adjustment mechanism, such as a buckle including a loop element through which the strap is threaded.

The second strap 42 is preferably similarly configured to the first, including first and second portions 48,50. The first portion 48 is associated with the first side 30, and the second portion 50 with the flap 41.

In one embodiment, the straps 40,42 are located near a lower portion of the first and second sides 30,32, including the flap 41. In this embodiment, the zipper 34 does not extend along the entire length of the edges 36,38 of the first and second sides 30,32. Instead, the zipper 34 extends only to the lower panel P4 where the flap 41 is provided.

In another embodiment, the zipper 34 may be provided along the length of both sides 30,32. In this embodiment, the zipper 34 may extend beneath the flap 41, such that the flap 41 extends over the zipper 34.

In a preferred embodiment, the vest 20 defines an opening 52 through which the neck of a wearer may pass. As illustrated, the opening 52 is generally defined between the front 22 and rear or back 24 of the vest 20. As illustrated, the edges 36,38 of the first and second sides 30,32 terminate at a front portion of the opening 52.

In general, the vest 20 defines an interior which will accept the torso of a wearer. As described below in more detail, the first and second sides 30,32 are separable to permit the wearer to pass their arms through the arm openings 26,28 and extend the first and second sides 30,32 their body.

Figure 2:
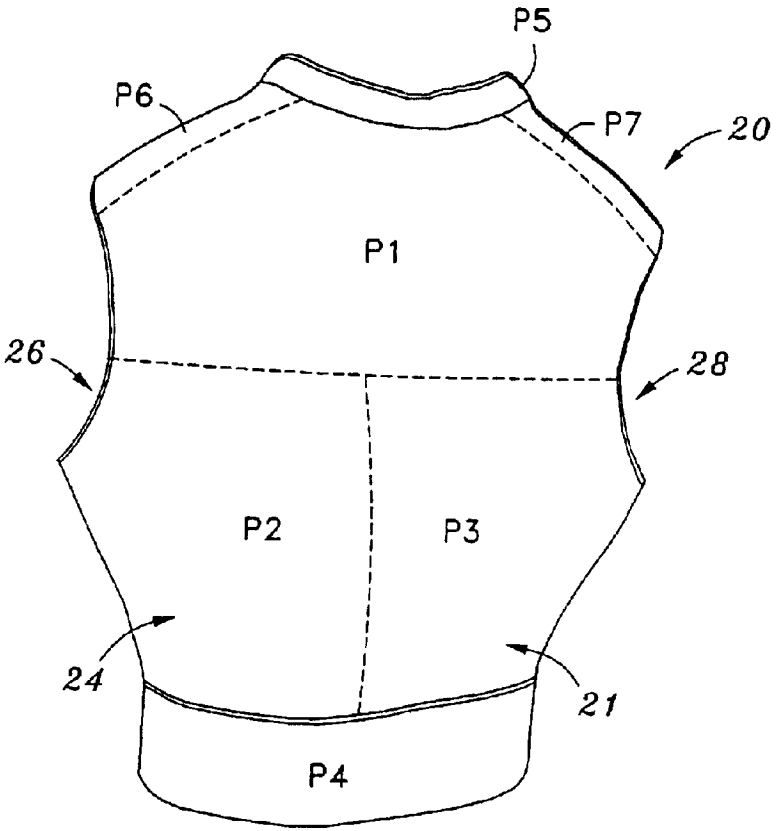
FIG. 2 is a rear view of the weight vest illustrated in FIG. 1.

In a preferred embodiment, the front 22 and back 24 of the vest 20 are constructed from a plurality of individual panels which are connected. As illustrated in FIG. 2, in one embodiment the back 24 preferably comprises a generally triangular first or upper torso panel P1. This panel P1 extends between the arm openings 26,28 from just below the neck opening 52 downwardly generally midway along the back 24 of the vest 20. Below the panel P1, a pair of panels P2 and P3 are provided. These panels P2,P3 extend from the first panel P1 downwardly to a lower panel P4. The panel P4 comprises a generally narrow band of material which encircles the vest 20, except for the discontinuity at the front 22.

Above the panel P1 is a narrow panel P5 defining a periphery of the neck opening 52. Panels P6 and P7 are provided above the panel P1 to either side of the neck opening 52. These panels P6,P7 generally extend over the shoulders of a wearer when the vest 20 is worn.

The first and second sides 30,32 are generally defined by a panels P8, P9, P10 and P11. These panels P8-P11 extend downwardly from the panels P6 and P7 to the lower panel P4.

In a preferred embodiment, the panels are all permanently connected to one another. In one embodiment, the panels are stitched to one another.

As one aspect of the invention, the panels forming the vest 20 are preferably constructed of neoprene or a material having similar qualities. In particular, it is desired that the material forming the shell or body of the vest 20 be constructed of a material which is durable, and which is also elastic or semi-elastic so that it will stretch and form fit to the shape of a user's body.

The vest 20 may be of a variety of colors. In one embodiment, one or more of the panels comprising the shell or body of the vest 20 are of one color, while others are of another color. For example, panels P6, P11 and P4 may be of a different color than the remaining panels to provide a visually appealing color pattern. In the embodiment illustrated, panel P11 is provided as a separate panel from panels P9 and P10 to accommodate the difference in color. Of course, the second side 32 could be constructed of a single panel, like the first side 30.

In one embodiment, printing, decals or the like may be placed on the exterior of the panels. For example, decals comprising particular logos may be placed on the exterior of one or more of the panels 20, such as the panel P1 or the panels P8 and/or P11.

In one embodiment, the lining 23 is provided at the interior of the shell 21. Referring to FIG. 3, the lining 23 preferably comprises one or more elements separate from the shell 21, but connected to the shell. In a preferred embodiment, the lining 23 comprises a cotton mesh fabric. The fabric is stitched or otherwise securely connected to the shell 21. Preferably, the lining 23 has nearly the same shape and dimensions as the interior of the shell 21, preventing buckling, creasing, folding and the like of the lining 23 beneath the shell 21 when the vest 20 is being worn.

In accordance with the present invention, at least one means is provided for connecting or otherwise associating at least one weight with the vest 20. In a preferred embodiment, this means comprises at least one pocket associated with the lining 23 of the vest 20.

As illustrated in FIG. 3, several pockets are associated with the lining 23. First and second pockets 60,62 are positioned to either side of the first arm opening 26. In one embodiment, each pocket 60,62 comprises a member which has a front and back, three closed sides and a selectively openable fourth side. The front and back are formed from layers of the lining material, with the three closed sides comprising portions of the lining material connected to one another. The front and back of each compartment may be referred to as a wall. The fourth side comprises an opening between the layers of lining material. This opening is accessible from the interior of the shell 21.

The pockets 60,62 are preferably sized to accept a weight. In one embodiment, the pockets 60,62 are arranged to accept a thin, generally rectangular shaped metal weight.

In a preferred embodiment, means are provided for selectively closing the opening or fourth side of each pocket 60,62. In one embodiment, this means comprises a flap 64. The flap 64 is connected to the lining 23 at a location spaced from the fourth opening. In its normal position, the flap 64 extends in a direction of the fourth opening, over the top of at least a portion of the pocket itself. In one embodiment, the fourth or open side need not comprise the "top" of the pocket 60,62, with reference to the top of the vest, but may instead comprise one of the other portions thereof. In a preferred embodiment, the opening sides of the pockets 60,62,66,68 near the arm openings 26,28 are not at the top, but along one of the elongate sides thereof.

In one embodiment, means are provided for selectively securing the flap 64 in a closed position and permitting the flap 64 to be moved to a position in which it does not obscure the opening to the pocket 60,62. In one embodiment, this means comprises hook and loop fastener material. A first portion of the hook and loop fastener material is associated with an inside surface of the flap 64. A mating portion of the hook and loop fastener material is associated with an external portion of the pocket 60,62. As described below in more detail, the flap 64 may be moved to a position in which it extends over the fourth side or opening of its respective pocket 60,62, closing the opening and preventing the removal of a weight therein. The hook and loop material or other fastener secures the flap 64 in this closed position.

The flap 64 may also be moved to an open position in which it does not obscure the opening or fourth side of its respective pocket 60,62. At this time, a weight may be removed from the pocket or placed in the pocket.

As illustrated, similar pockets 66,68 are preferably located at opposing sides of the second arm opening 28. Preferably, a flap 64 is also associated with each of these pockets 66,68.

In a preferred embodiment, additional pockets 70,72,74,76 are spaced along the bottom inside edge of the vest 20. These pockets 70,72,74,76 are located in an area corresponding to the inside of the panel P4 which forms the lower portion of the shell 21 of the vest 20.

In one embodiment, each of the pockets 70,72,74,76 has a corresponding flap 64 for selective opening and closing an opening into the pocket. Preferably, the opening or fourth side of each pocket 70,72,74,76 is along a top of the pocket and the flap 64 extends over the opening.

Hook and loop fastener material or one or more other fasteners are preferably provided for securing the flaps 64 into a closed position over the opening to each pocket 70,72,74,76.

In a preferred embodiment, one or more of the pockets are divided in to a plurality of individual compartments. In one embodiment, the four pockets 60,62,66,68 located adjacent the arm openings 26,28 are each divided into four compartments. The smaller pockets 70,76 along the bottom edge of the vest 20 are also divided into four compartments. The larger pockets 72,74 along the bottom edge of the vest 20 are divided into eight compartments. In this arrangement, the vest 20 includes forty (40) individual compartments for accepting a weight. In other embodiments, the pockets may define other numbers of compartments.

Figure 4:
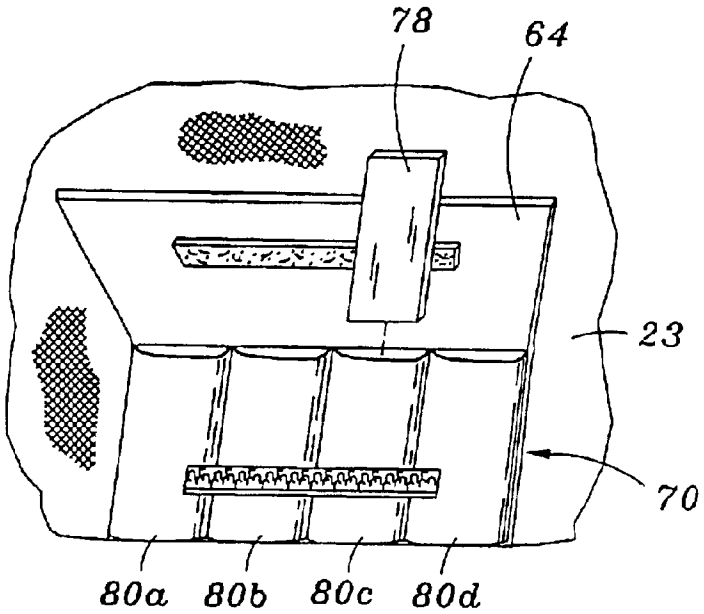
FIG. 4 is an enlarged view of a portion of the vest illustrated in FIG. 3, illustrating how weight is associated with the vest.

FIG. 4 illustrates in greater detail the pocket 70 including its four compartments. As illustrated, this pocket 70 includes four compartments 80*a*,80*b*,80*c*,80*d*. In one embodiment, the compartments 80*a–d* are formed by stitching a front portion of the pocket 70 to a rear portion thereof. Each compartment 80*a–d* has front and rear walls formed of material, and four sides. Three sides are closed, and one is openable. Preferably, the compartments 80*a–d* are formed to accept individual weight elements 78. In one embodiment, these weights or weight elements 78 are about 1 inch wide, 4–5 inches long, and about 0.5 inches in thickness. The compartments 80*a–d* are preferably configured to isolate the weight elements 78 from one another and to snugly hold the weight elements in the pocket.

In one or more embodiments, the other pockets of the vest 20 are similarly configured. Of course, the size of the compartments need not all be the same. One or more of the compartments may be larger or smaller, or shaped differently for holding weights having different sizes or shapes.

A variety of alternate configurations of the vest 20 from that described above and illustrated in FIGS. 1–4 are contemplated.

In one embodiment, one or more fasteners or fastening means other than hook and loop material may be used to secure the flaps 64 into a position in which they close the fourth side or opening of each pocket. For example, snaps, zippers, ties or the like may be used to secure the flaps into a closed position.

Means other than a flap may be used to close the pockets or individual compartments. For example, a zipper may be provided across the openable end of the pocket or compartments. In addition, a number of individual flaps may be provided, such as one flap for each compartment. In one embodiment hook and loop fastener material may be associated with the two layers of material or walls forming the compartments at their openable end. In this arrangement, the openable end of a compartment may be closed by pressing the hook and loop material together, connecting the opposing portions of material forming the compartment. The compartment may be opened by separating the walls.

In one or more embodiments, the shell 21 may be formed from a greater or lesser number of panels, including panels shaped other than as described and illustrated. In one embodiment, the shell 21 may comprise a unitary element. An advantage of unitary construction is the elimination of seams.

The shell 21 may be constructed in a variety of sizes to fit a variety of differing sized wearers. The shell 21 may have a variety of colors and accessories associated therewith.

Figure 6:
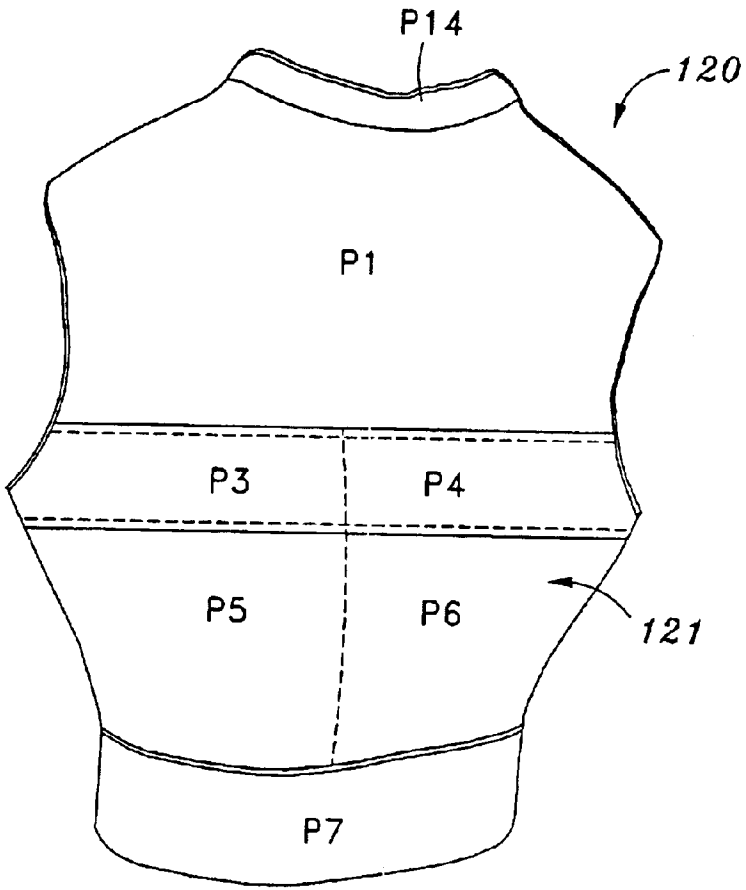
FIG. 6 is a rear view of the weight vest illustrated in FIG. 5.
Figure 5:
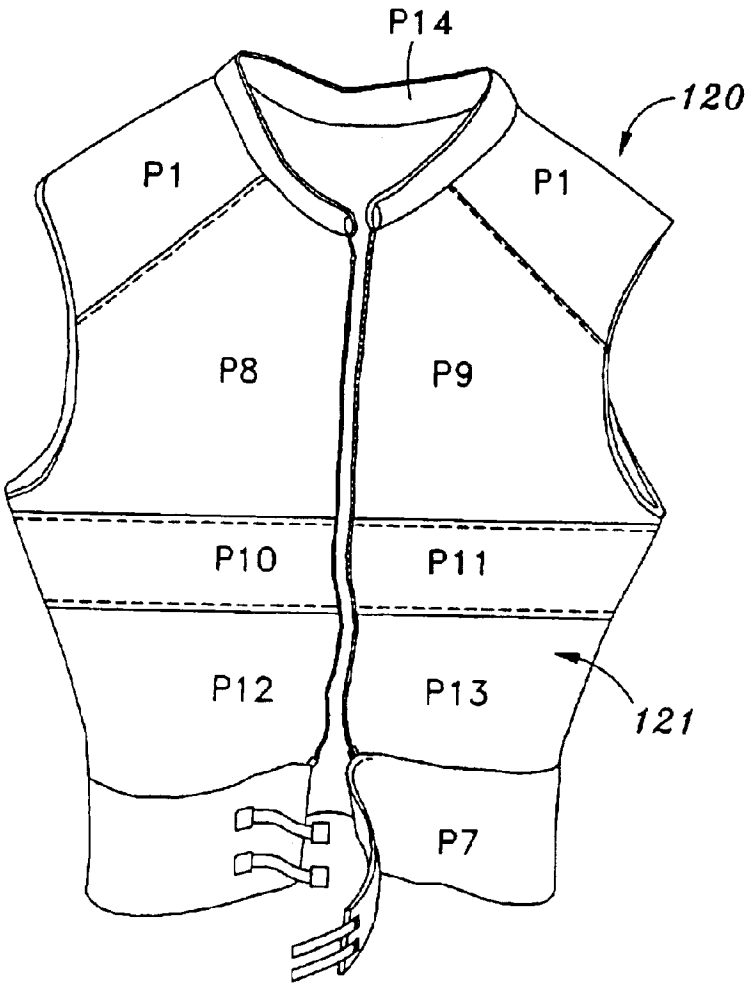
FIG. 5 is a front view of another embodiment of a weight vest in accordance with the invention.

FIGS. 5 and 6 are illustrative of another configuration of a vest 120 in accordance with an embodiment of the present invention. In one embodiment, this vest 120 is particularly configured to be worn by a female, while the vest 20 illustrated in FIGS. 1 and 2 are particularly designed to be worn by a male. In general, this embodiment vest 120 is identical to the vest 20 described above and illustrated in FIGS. 1–4, except that the arrangement of panels comprising a shell 121 of the vest 120 differs.

As illustrated in FIGS. 5 and 6, a first panel P1 comprises a shoulder portion of the vest 120. Referring only to FIG. 6, panels P3, P4, P5 and P6 constitute the rear portion of the vest 120. A panel P7 is located at the lower edge of the vest 120. Referring to FIG. 6, this panel P7 preferably generally encircles the vest 120.

As illustrated in FIG. 5, the front of the vest 120 includes a six panels P8, P9, P1, P11, P12 and P13. The panels defining opposing first and second sides, each having an edge which is connectable to the other with a zipper or other fastening member(s).

In one embodiment, the panels P3,P4,P7,P10 and P11 are constructed of a material having a different color that the material forming the other panels. In this configuration, the panels create a visually appealing color patten.

In one embodiment, means may be provided for selectively coupling the first and second sides of the front of the shell of the vest of the invention other than or in addition to the zipper, flap and straps. For example, buttons or snaps may be utilized, as may mating hook and loop fastening material.

Use of the vest 20 in accordance with the present invention will now be described in greater detail with reference to FIGS. 1–4. It will be understood that use of the vest 120 illustrated in FIGS. 5 and 6 is essentially the same. A user selects the particular weight or weights, if any, which they wish to associate with the vest 20. Of course, a user may desire to not associate any weights with the vest 20 and simply wear the vest 20 as configured.

In a preferred embodiment, the weights 78 which are utilized with the vest 20 have a configuration as illustrated in FIG. 4. As illustrated, these weights are constructed from metal, such as cast iron or stainless steel. The weights 78 are thin and generally rectangular in shape. As described in more detail below, this particular weight configuration has several advantages. Of course, a user may utilize weights having a variety of configurations.

In one embodiment, a user utilizes weights having a mass of approximately 1 pound for the compartments of the vest 20. Weights having other masses may be used, such as 0.5 pounds or 2 pounds. Weights having a greater or lesser mass may be used.

The user places a weight in each of the pockets 60,62, 66,68,70,72,74,76,78 as desired. In general, the user opens the flap 64 associated with each pocket to expose the fourth side or opening to each pocket or the compartments thereof. The user then places the desired weight in the pocket. In the preferred embodiment where each pocket includes a plurality of individual weight compartments, the user may place a weight in any or all of the compartments, as desired.

In an embodiment where weights having a mass of 1 pound are used and the pockets have 40 compartments, the maximum mass of the weights which may be associated with the vest comprises 40 pounds. The total mass which may be associated with the vest may vary dependent upon the mass of the weights used, the number of weights used, and the number of compartments provided.

Next, the user closes the flap 64 associated with each pocket. The flap 64 is secured into a closed position, such as by engaging the provided hook and loop fastening material.

The user then places the vest 20 on their body. The user ensures that the zipper 34 is unzipped and the straps 40,42 and flap 41 are disconnected, allowing movement of the first side 30 of the front 22 of the shell 21 relative to the second side 32.

The user extends their arms through the first and second arm openings 26,28 and aligns their neck with the neck opening 52. The user opens the sides 30,32 sufficient to extend them around the front of their torso. The user then zips the zipper 34, securing the first and second sides 30,32 of the front 22 of the shell 21 to one another. In addition, the user optionally secures the first and second sides 30,32 of the vest 20 with the flap 41. To do so, the user pulls the flap 41 across the first side 30 of the vest 20 and secures it with the hook and loop fastening material or other means for connection.

In one embodiment, the user may also connect opposing portions 44,46 of the first strap 40 and the opposing portions 48,50 of the second strap 42 to one another. If necessary, the user may shorten or lengthen the straps 40,42 to obtain a snug and secure fit of the vest 20 about their body. It will be appreciated that by changing the length of the straps, the user may change the size of the perimeter of the vest 20 at its bottom edge. By reducing the size of the perimeter, the user tightens the vest 20 about their body.

With the vest 20 so positioned on their body, a user may engage in any of a variety of activities. These activities may include specific exercises, such as running, lunges, squats, push-ups, sit-ups and other activities. The user may also engage in activities which are not specifically intended to be exercises, such as household chores, walking, shopping and the like. Regardless, the additional weight which is borne by the user is useful in working the user's various muscles.

One or more of the steps of use may occur in an order other than described above. For example, a user may place the vest on their body, and then place one or more weights in the vest. In addition, a user may remove weights from the vest.

The vest 20,120 in accordance with the present invention has numerous advantages and overcomes significant problems associated with prior art exercise apparatus.

In accordance with the invention, a vest is provided which is capable of accepting weights, where the weights are secured. First, the weights are located in individual pockets or compartments, preventing the weights from shifting during movement of the wearer or from falling from the vest. In addition, the weights are located in pockets which are located at the interior of the shell of the vest. When the vest is worn, the weights are tightly held between the wearer's body and the shell of the vest, securely holding the weights in place.

The construction of the vest contributes to the high degree to which the weights are secured. As indicated above, a significant problem with prior devices is that the weights may move relative to a user. This problem is exacerbated when the user's movements are accentuated, such as when the user exercises.

In accordance with the invention, a vest is provided which secures the weights so that the weights do not move relative to the user's body. Because the weights move with, and not relative to the user's body, problems such as imbalance, discomfort and the like are eliminated.

As indicated, in a preferred embodiment, the shell is constructed of multiple panels. These panels can be customized in size and shape, so that the assembled vest is adapted to fit a particular wearer perfectly. As noted, the vest of the invention may be specially configured to be worn by a female (ex. FIGS. 5–6) or a male (ex. FIGS. 1–2). Any particular vest configuration may be provided. For example, two different users may have a shoulder area having the same size and shape, but have a different mid-torso area. In that event, when considering the embodiment vest 20 illustrated in FIGS. 1–4, the panels P1,P6 and P7 may be the same for each vest, but the panels P2 and P3 may be larger in the case of one of the vests.

The material from which the vest 20 is constructed also contributes to the securing of the weights. As described, in a preferred embodiment, the vest 20 is constructed from a durable but flexible/elastic material. Preferably, the vest 20 is sized so that it fits the user snugly. In one embodiment, when the user zips the zipper 34, the first and second sides 30,32 are pulled towards one another, tightly encircling the user. The elasticity of the vest material permits sufficient stretching of the material that any gap between the first and second sides 30,32 before the zipper 34 is zipped is closed when the zipper is zipped.

So that the weights associated with the pockets 70,72,74, 76 along the lower edge of the vest are secured, the user preferably tightens the straps 40,42 and the flap 41. The straps 40,42 and the flap 41 permit the wearer to specifically tighten the vest 20 against their body in the location of these weights, compressing the weights between the vest and their body.

Another aspect of the invention is that the vest permits location of the weights in anatomically advantageous positions. First, one or more weights may be located near the bottom edge of the vest, corresponding to the user's waist. In this location, the weights are secured about the structurally sound hip area of the body. This area of the body is adapted to carry heavy loads, and is centrally located such that the extra weight is unlikely to interfere with balance. Second, weights may be located in an area corresponding to the front and rear shoulder, adjacent each arm. Again, the body is adapted to support loads in the shoulder area. In addition, the mind and body are already design to address balance (or imbalance) arising from movement of the arms. The weights are similarly located and thus do not generally effect the balance or other movements of the user.

Location of the weights in different areas is also advantageous since such permits the weights to be useful in a greater variety of situations. For example, any weights associated with the vest are useful in training when running, jumping or the like. When doing sit-ups, however, the weights located at the lower edge of the vest are near the pivot point of the body, and have less effect than do weights located in the pockets near the arm openings.

The construction of the vest is such that it is extremely comfortable. Another problem with prior devices is that when applied to the body, they are often not comfortable. This leads to a user stopping the use of the device.

As noted above, in one embodiment, the comfort of the vest 20,120 arises from its multi-panel construction. This construction permits the vest to be particularly sized and shaped to fit the body. In addition, the shell of the vest comprises a somewhat elastic material, allowing the shell to conform to the shape of the body.

The vest 20,120 also comprises a separate shell and lining. As will be appreciated, during exercise if an article of clothing tightly adheres to the body but moves even slightly relative thereto, then a rubbing effect results. The user may get blisters or scrapes as a result of this relative movement. In accordance with the invention, the lining acts as a buffer between the more rigid structural shell and the user's body. Some movement of this shell is permitted relative to the lining, which protects the underlying body of the user.

The lining also lends directly to the comfort of the vest 20,120. As indicated, the shell of the vest is preferably constructed of a durable material such as a cotton/nylon, rayon or poly blend. While this type of material is advantageous because of its structural abilities, the material does not breathe well. The lining is a mesh material which includes perforations which permit air to flow there through.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A weight vest comprising:

a shell constructed of a plurality of panels, said panels defining a front and a back of said vest, said front having a first side and a second side, said first side and said second side selectively connectable with a zipper, said shell including a first arm opening, a second arm opening and a neck opening, said shell having an exterior and an interior, one or more of said panels comprising a materials having elastic qualities, said shell having a lower portion generally opposite said neck opening;

a lining, said lining connected to said shell and located at said interior thereof; and a plurality of weight pockets associated with said lining, said weight pockets defining a space in which a weight may be located at said interior of said shell.

2. The weight vest in accordance with claim 2 wherein a plurality of said weight pockets are located adjacent said first arm opening and a plurality of said weight pockets are located adjacent said second arm opening.

3. The weight vest in accordance with claim 1 wherein a plurality of said weight pockets are located at said lower portion of said shell.

4. The weight vest in accordance with claim 1 wherein said neck opening is defined by a neck panel, said lower portion of said shell is defined by a lower panel, said back is defined by a plurality of first panels connected to one another and located between said neck panel and said lower panel, and said front is defined by a plurality of second panels, each of said second panels connected to at least one of said first panels and said second panels positioned between said neck panel and said lower panel.

5. The weight vest in accordance with claim 4 wherein at least one of said second panels has a first end connected to said neck panel and a second end connected to said lower panel.

6. The weight vest in accordance with claim 4 wherein a plurality of said weight pockets are associated with said lower panel.

7. The weight vest in accordance with claim 1 wherein said lining comprises at least a first and second layer and a front of one or more weight pockets is defined by said first layer of said lining and a back of one or more of said weight pockets is defined by said second layer of said lining.

8. The weight vest in accordance with claim 7 wherein said second layer of said lining is located between said first layer and said shell, and wherein an opening leading into one or more of said weight pockets comprises a passage through said first layer.

9. The weight vest in accordance with claim 7 wherein one or more sides of one or more weight pockets comprise areas where said first and second layers of said lining are connected.

10. The weight vest in accordance with claim 8 including a flap for selectively closing said opening.

* * * * *

UNITED STATES PATENT AND TRADEMARK OFFICE

CERTIFICATE OF CORRECTION

PATENT NO. : 6,834,396 B2
DATED : December 28, 2004
INVENTOR(S) : Ana F. Franco-Sion It is certified that error appears in the above-identified patent and that said Letters Patent is hereby corrected as shown below:

Column 7,
Line 44, "P1" should be -- P10 --;

Column 10,
Line 61, "claim 2" should be -- claim 1 --.

Signed and Sealed this

Twenty-ninth Day of March, 2005

JON W. DUDAS
*Director of the United States Patent and Trademark Office*